US009915057B2

(12) United States Patent
Williams

(10) Patent No.: US 9,915,057 B2
(45) Date of Patent: Mar. 13, 2018

(54) BATHROOM SINK ACCESSORY

(71) Applicant: Janna Williams, Monroe, OH (US)

(72) Inventor: Janna Williams, Monroe, OH (US)

(73) Assignee: CREATIVE BLONDE, LLC, Monroe, OH (US)

( * ) Notice: Subject to any disclaimer, the term of this patent is extended or adjusted under 35 U.S.C. 154(b) by 0 days.

(21) Appl. No.: 15/007,546

(22) Filed: Jan. 27, 2016

(65) Prior Publication Data

US 2016/0215484 A1 Jul. 28, 2016

Related U.S. Application Data

(60) Provisional application No. 62/108,325, filed on Jan. 27, 2015.

(51) Int. Cl.
*A47B 5/04* (2006.01)
*E03C 1/186* (2006.01)

(52) U.S. Cl.
CPC ..... *E03C 1/186* (2013.01)

(58) Field of Classification Search
CPC ..... E03C 1/186; A47B 13/02; A47B 13/081; A47B 5/04; A47B 5/06; A47B 5/10; A47B 3/091; A47B 3/00; A47B 3/002
USPC ..... 108/67, 166, 167, 171, 38, 33–36, 115, 108/162, 168, 172–174, 169, 170, 43, 25; 4/559, 571.1; 312/228.1
See application file for complete search history.

(56) References Cited

U.S. PATENT DOCUMENTS 297,219 A * 4/1884 Anthony
696,044 A * 3/1902 Hoffman
914,120 A * 3/1909 Demarest ..... E03C 1/186 4/638
1,063,642 A * 6/1913 Birdsall ..... A47B 1/08 108/132
1,751,536 A * 3/1930 Thomson ..... A47B 5/04 108/152
2,547,382 A * 4/1951 Freeman ..... A47B 77/022 108/166
3,300,265 A * 1/1967 Wilmer ..... A47B 63/00 160/206
3,791,314 A * 2/1974 Berretta ..... A47B 97/02 108/43
4,082,391 A * 4/1978 Turner ..... B60P 3/36 126/332
4,305,166 A 12/1981 Rose
4,519,656 A 5/1985 Raz
5,106,156 A * 4/1992 Marquis ..... B60N 3/002 108/43

(Continued)

FOREIGN PATENT DOCUMENTS

CN 203264058 U 11/2013
DE 4120957 * 1/1993

(Continued)

OTHER PUBLICATIONS

English machine translation of CN 203264058U.

*Primary Examiner* — Janet M Wilkens
(74) *Attorney, Agent, or Firm* — King & Schickli, PLLC

(57) ABSTRACT

An apparatus for use with a sink having a basin. The apparatus includes a plurality of interconnected panels for positioning on a top surface of the sink. The plurality of interconnected panels are configured to be positionable in a first position to cover the sink basin and a second position for storage.

12 Claims, 10 Drawing Sheets

(56) References Cited

U.S. PATENT DOCUMENTS

| | | | | | |
|---|---|---|---|---|---|
| 5,475,880 | A * | 12/1995 | Guenther | A47K 3/122 | 108/67 |
| 5,815,855 | A * | 10/1998 | McKeehan | E03C 1/186 | 165/185 |
| 5,884,889 | A * | 3/1999 | Crosby | A47B 23/04 | 248/444 |
| 5,890,605 | A | 4/1999 | Percudani | | |
| 6,502,570 | B2 * | 1/2003 | Grady | F24C 15/12 | 126/37 A |
| 6,568,009 | B2 * | 5/2003 | Linger | A61G 1/013 | 128/870 |
| 6,918,147 | B2 | 7/2005 | Stackman et al. | | |
| 7,096,797 | B2 * | 8/2006 | Sharpe | A47B 3/00 | 108/43 |
| D554,805 | S | 11/2007 | Moon | | |
| 7,950,337 | B2 * | 5/2011 | Chen | A47B 3/00 | 108/115 |
| 9,232,862 | B1 * | 1/2016 | Arch | A47D 5/006 | |
| 2005/0172397 | A1 | 8/2005 | Jones | | |
| 2006/0156763 | A1 * | 7/2006 | Vecchi | D06F 19/00 | 68/3 SS |
| 2006/0249642 | A1 * | 11/2006 | Mavis | A47B 91/005 | 248/346.3 |
| 2006/0254472 | A1 * | 11/2006 | Goldberg | A47B 23/001 | 108/50.11 |
| 2008/0173246 | A1 * | 7/2008 | Barkdoll | A01K 7/005 | 119/74 |
| 2010/0132111 | A1 | 6/2010 | Na | | |
| 2011/0219535 | A1 | 9/2011 | Bouroullec et al. | | |
| 2012/0167294 | A1 | 7/2012 | Ben-Menachem | | |
| 2012/0227638 | A1 * | 9/2012 | Boda | A47B 13/16 | 108/28 |
| 2012/0282429 | A1 * | 11/2012 | DiNello | B29C 41/18 | 428/71 |
| 2013/0098276 | A1 * | 4/2013 | Trinko | A61G 13/009 | 108/33 |
| 2014/0137321 | A1 | 5/2014 | Clayton et al. | | |
| 2014/0250588 | A1 * | 9/2014 | Chen | E03C 1/186 | 4/631 |
| 2016/0257405 | A1 * | 9/2016 | Vandewall | B64D 11/02 | |

FOREIGN PATENT DOCUMENTS

| | | | |
|---|---|---|---|
| DE | 4120967 | * | 1/1993 |
| GB | 673122 | * | 6/1952 |
| GB | 2181944 | * | 5/1987 |

* cited by examiner

BATHROOM SINK ACCESSORY

This application claims the benefit of U.S. Provisional Patent Application Ser. No. 62/108,325, filed on Jan. 27, 2015, the disclosure of which is incorporated herein by reference.

TECHNICAL FIELD

This disclosure relates generally to bathroom storage accessories and, more particularly, to an apparatus configured to removably cover a bathroom sink for supporting cosmetics, vanity and other personal products for use in and around the sink of a bathroom especially in bathrooms of limited space.

BACKGROUND

It is well known that many bathrooms, such as ones located in smaller homes or apartments, guest bedrooms, college dormitories and hotels especially in Europe have pedestal-type sinks or other kinds of smaller sinks, which typically do not have any drawers or storage space for holding personal hygiene products, cosmetic products and other accessories and products. Furthermore, pedestal-type sinks and other smaller sinks have minimal surface area, which provide very little countertop space for the types of products discussed above. In this limited amount of space, it is difficult, if not impossible, to place all the necessary personal products on the space for efficient accessibility. Even if all the necessary personal products are able to be placed on the countertop space, it creates a cluttered appearance and it is difficult to access certain items without knocking certain products onto the bathroom floor or into the basin of the sink. This is disadvantageous for various reasons, including but not limited to the products may be damaged from the fall or become wet from water in the basin of the sink, which can damage the products and/or the individual.

Moreover, even if the sinks in these type of bathrooms have storage space for all of the hygiene and cosmetic products often used by people, especially women, it is ideal to have these products easily accessible on the countertop of the sink. To address the problems associated with pedestal-type sinks and other smaller sinks or vanities with limited countertop space, it is desirable to create additional countertop space without damaging or modifying the existing sink. Accordingly, there is a need for an apparatus that will be configurable to expand over any type of sink for increasing the surface area of the sink in a first position and easily stored in a second position. Furthermore, the apparatus should be sufficiently sturdy to support numerous personal products placed thereon, yet easily removable and transportable. Finally, the apparatus should be easy to clean as the personal products can easily spill and heat resistant for any hair styling tools.

SUMMARY

In accordance with one aspect of this disclosure, an apparatus for use with a sink having a basin is disclosed. The apparatus includes a plurality of interconnected panels for positioning on a top surface of the sink. The plurality of interconnected panels are configured to be positionable in a first position to cover the sink basin and a second position for storage. The plurality of interconnected panels may be hingedly connected or slidably connected. In one embodiment, each of the plurality of interconnected panels may be made of an anti-microbial plastic, a heat-resistant material and/or a non-pliable plastic material. Furthermore, the plurality of interconnected panels may be substantially rectangular-shaped or square-shaped. In another embodiment, at least one of the plurality of interconnected panels may have raised edges and/or be imprintable with a design or logo.

In yet another aspect of this disclosure, a portable apparatus for removably covering a top surface of a sink is disclosed. The portable apparatus includes a plastic, non-pliable body formed of a plurality of rigid panels, a plurality of pinned hinges connecting the plurality of panels. The plurality of panels are configurable to expand into an open position for covering the sink and configurable to fold into a closed position for storage. Each of the plurality of pinned hinges may be of the same size. Furthermore, the plastic, non-pliable body may be coated with an anti-microbial agent or have a heat-resistant top surface. The plurality of rigid panels may form a generally planar upper surface in the open position and be flush with a surface of the sink in the open position. Moreover, the plurality of rigid panels may be substantially parallel in a stackable configuration to one another in a closed position.

Another related aspect of this disclosure relates to a foldable bathroom sink cover. The cover includes a first inner section and a second inner section. The inner sections are foldably connected to each other via a pinned hinge extending along an inner edge of each of the inner section. The cover further includes a first outer section and a second outer section. The first outer section is foldably connected to the first inner section via a second pinned hinge extending along an outer edge of the first inner section. The second outer section is foldably connected to the second inner section via a third pinned hinge extending along an outer edge of the second inner section. Each of the first and second inner sections may have a raised edge along a top edge and a bottom edge. Furthermore, the first, second and third pinned hinges may be substantially the same size.

BRIEF DESCRIPTION OF THE DRAWINGS

The accompanying drawings incorporated in and forming a part of the specification, illustrate several aspects of this disclosure, and together with the description serve to explain the principles of the disclosure. In the drawings.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized and that process or other changes may be made without departing from the scope of the disclosure. The following detailed description is not to be taken in a limiting sense, and the scope of the invention is defined only by the appended claims and their equivalents. In accordance with the disclosure, an apparatus referred to as a "counterplus" for use with a pedestal-type sink or other sink or vanity with limited countertop space is hereinafter described.

Figure 1:
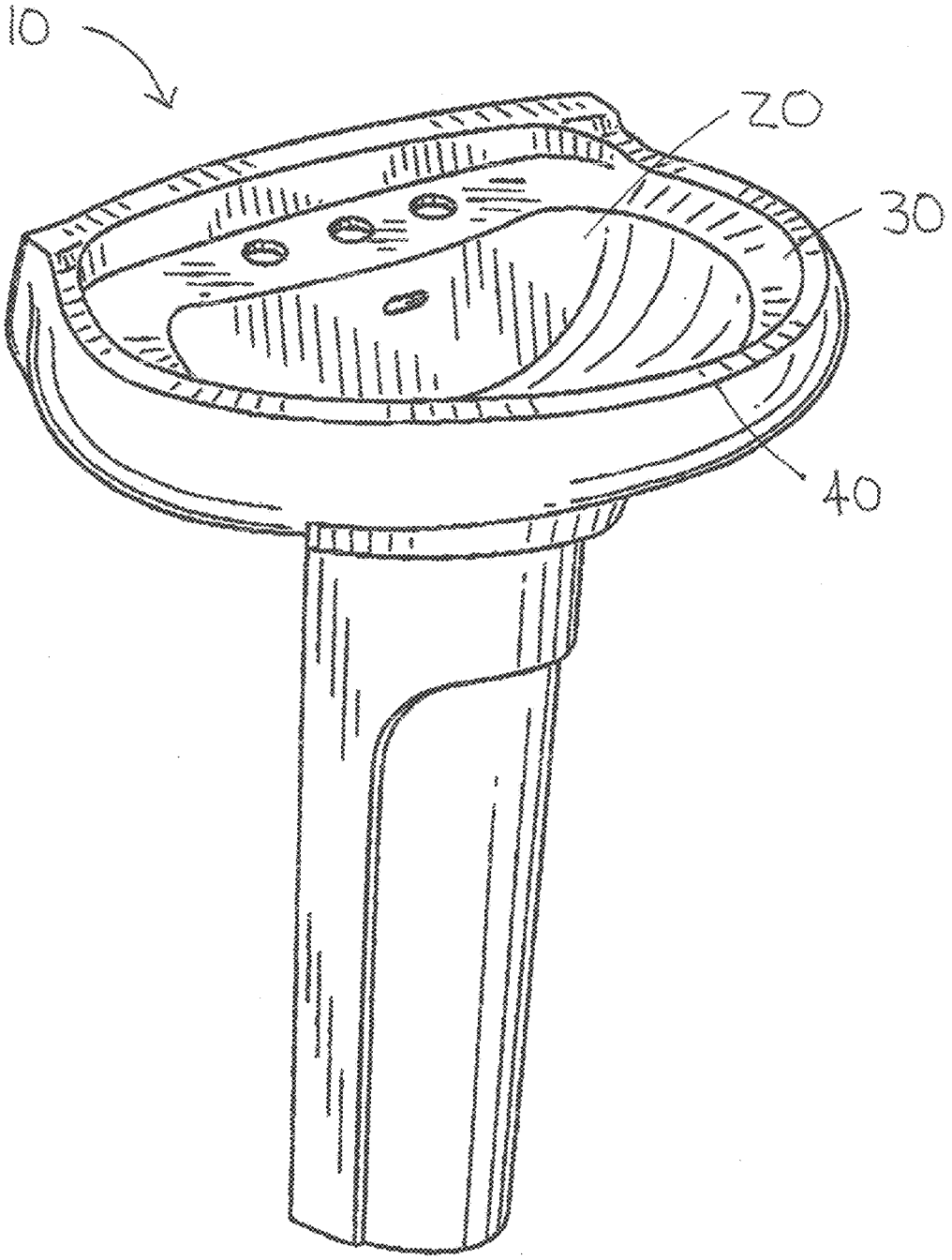
FIG. 1 is a perspective view of a traditional pedestal-type sink.

Reference is now made to FIG. 1, which is a perspective view illustrating a traditional pedestal-type sink 10. As illustrated, the sink 10 includes a basin 20 surrounding by an outer curved portion 30 forming the countertop space. The countertop space is essentially limited solely to the outer edge of the basin to the outer edge of the sink 40. Furthermore, the sink 10 does not include any drawers or additional space for storing supporting cosmetics, vanity and other personal products. Even in other types of sinks or vanities with drawers or additional storage space beneath the countertop, it is inconvenient to require the individual to continuously reach into the drawers for his/her personal products. Instead, it is much more convenient to be able to lay out all the personal products on the countertop for ease of use.

Figure 2:
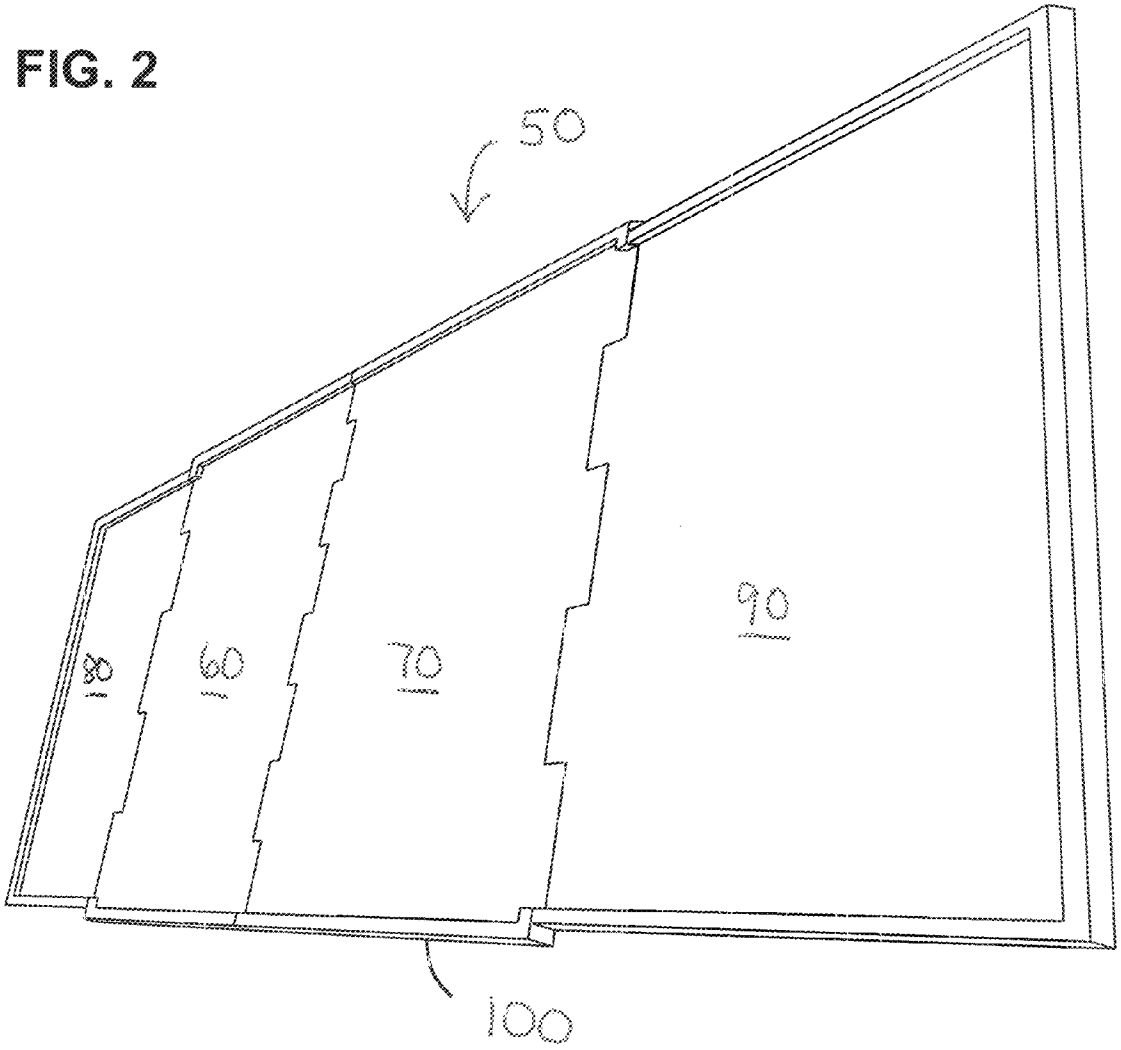
FIG. 2 is a top perspective view of an apparatus in an open configuration for use with a pedestal-type sink or other sink forming one aspect of this disclosure.
Figure 3:
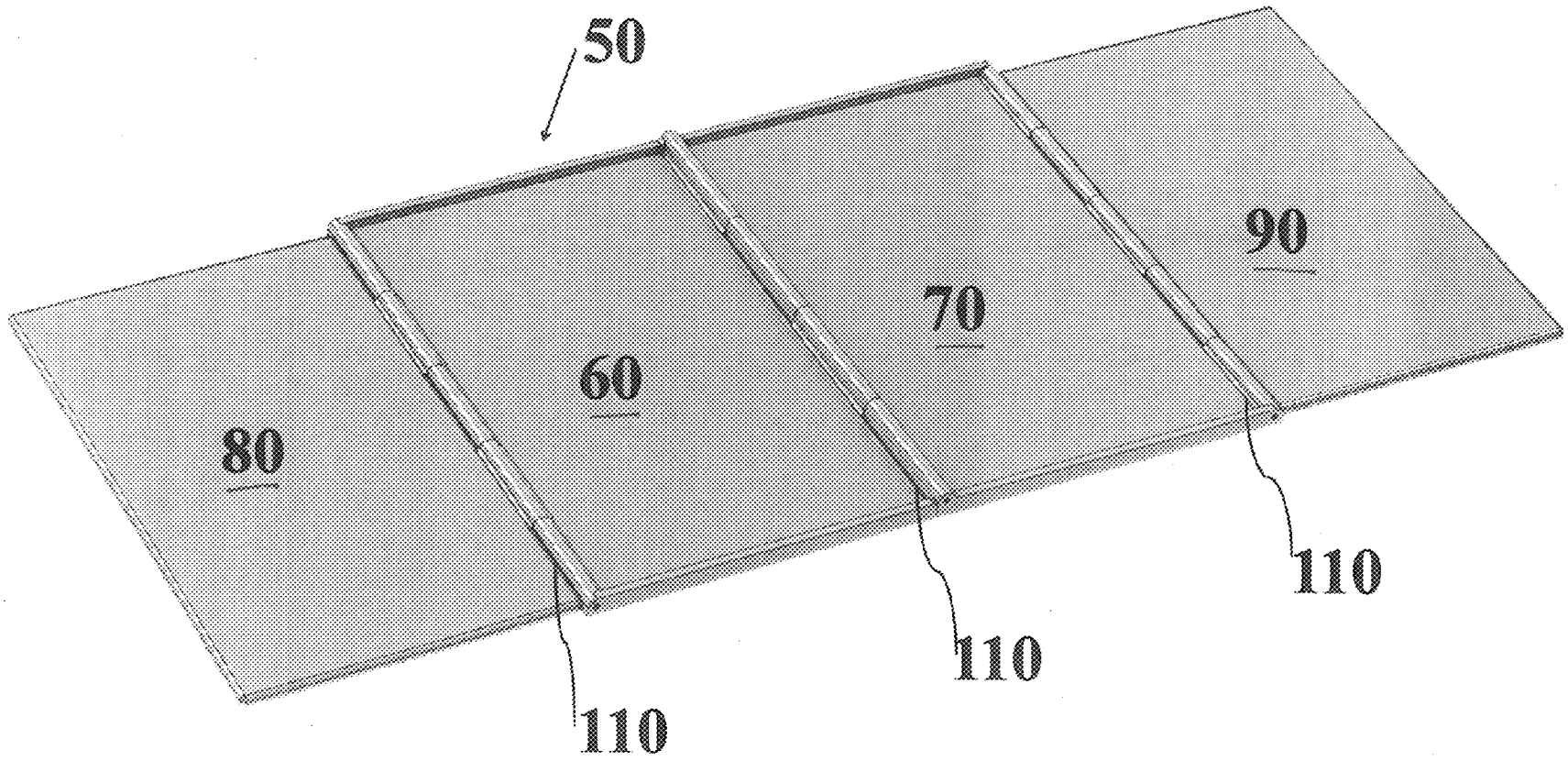
FIG. 3 is a bottom perspective view of the apparatus in an open configuration for use with a pedestal-type sink or other sink forming one aspect of this disclosure.

Turning to FIG. 2, the apparatus or "counterplus" 50 is illustrated. The apparatus 50 includes a plurality of interconnected panels or sections 60, 70, 80 and 90. The apparatus 50 is configured to expand over any type of sink over the sides or outer edge of the sink for increasing the overall surface area of the countertop space of the sink for placing personal hygiene products, cosmetic products and other accessories and products. In order to provide sufficient support, the body of the apparatus 50, including the panels is typically made of a sturdy, rigid, plastic material. The plastic material is not pliable, so it does not bend. Rather, as best shown in FIG. 3, the apparatus 50 includes a single pinned hinge (as opposed to overlapping or molded hinges) between each of the interconnected panels to allow the panels to expand or unfold as discussed in more detail below. As a result, the apparatus 50 provides sufficient support for numerous personal hygiene and cosmetic products being used in the bathroom.

The plastic material used for the apparatus 50 is preferably made with an anti-microbial material or coated with an anti-microbial agent for hygiene reasons as the products being placed thereon are typically being used on a person's body. Advantageously, the plastic material is sufficiently lightweight such that the apparatus 50 may be easily transported while traveling, yet sufficiently durable to hold a number of personal products being used in and around the sink. In addition, the plastic material is heat resistant such that curling irons and the like do not damage the surface of the apparatus. The anti-microbial and heat resistant finished surface of the apparatus 50 promotes durability and hygiene.

Figure 4:
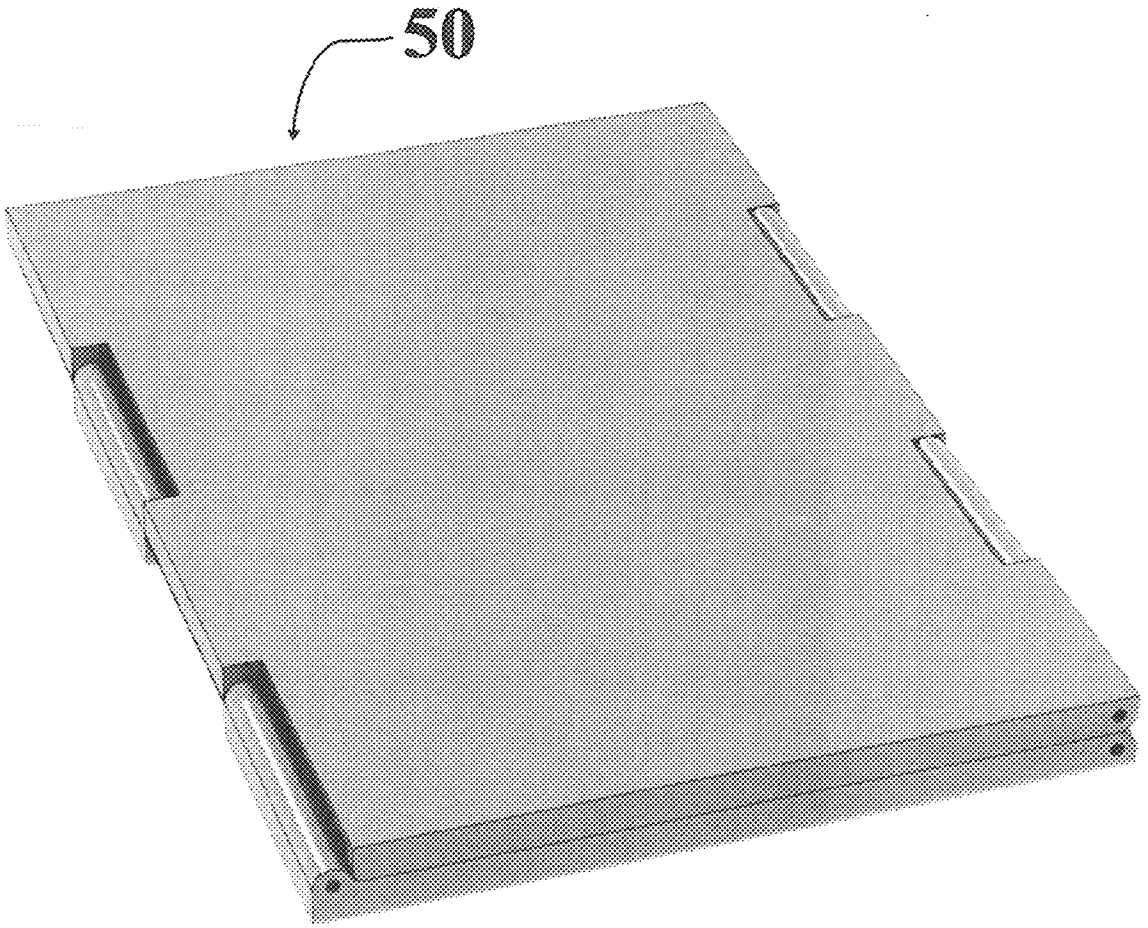
FIG. 4 is a perspective view of the apparatus in a folded, closed configuration for use with a pedestal-type sink or other sink forming one aspect of this disclosure.
Figure 5:
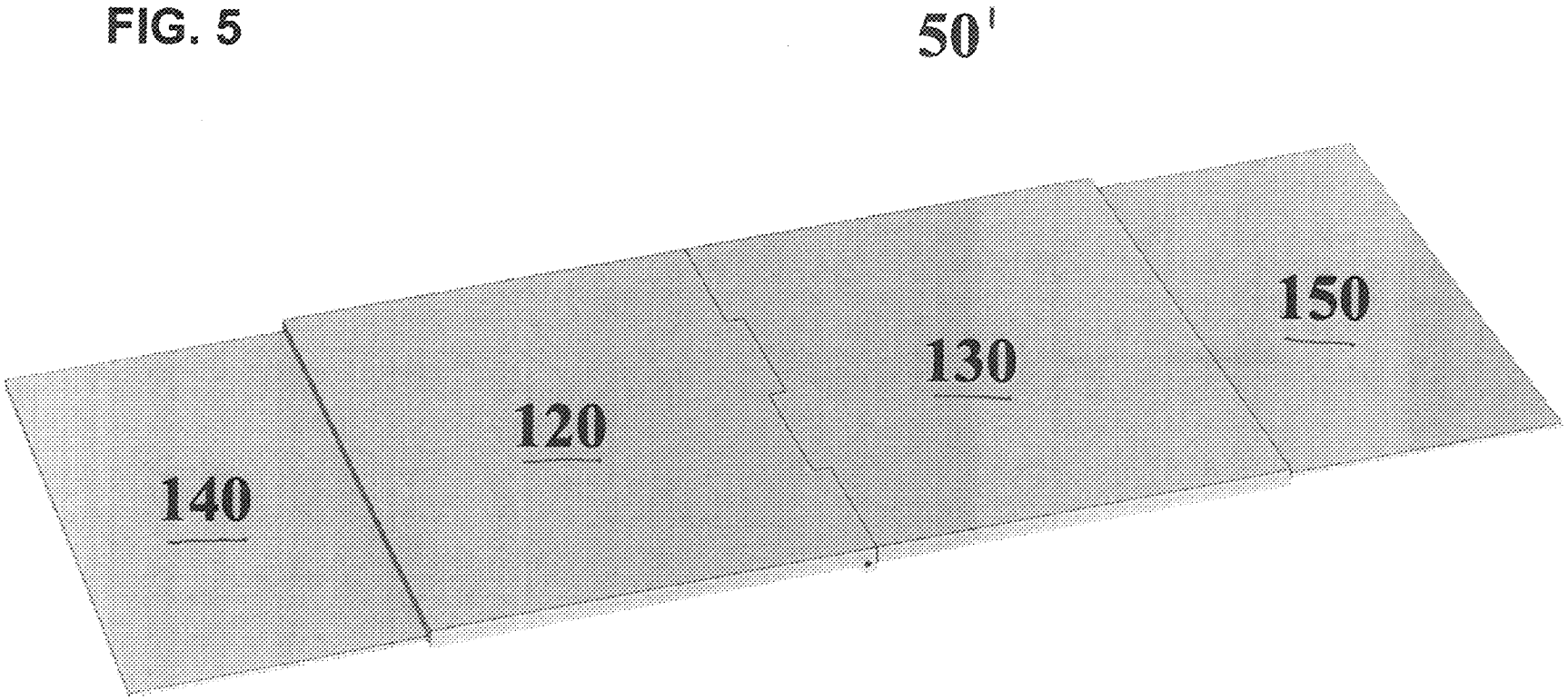
FIG. 5 is a top perspective view of an apparatus in an open configuration for use with a pedestal-type sink or other sink forming one aspect of this disclosure.
Figure 6:
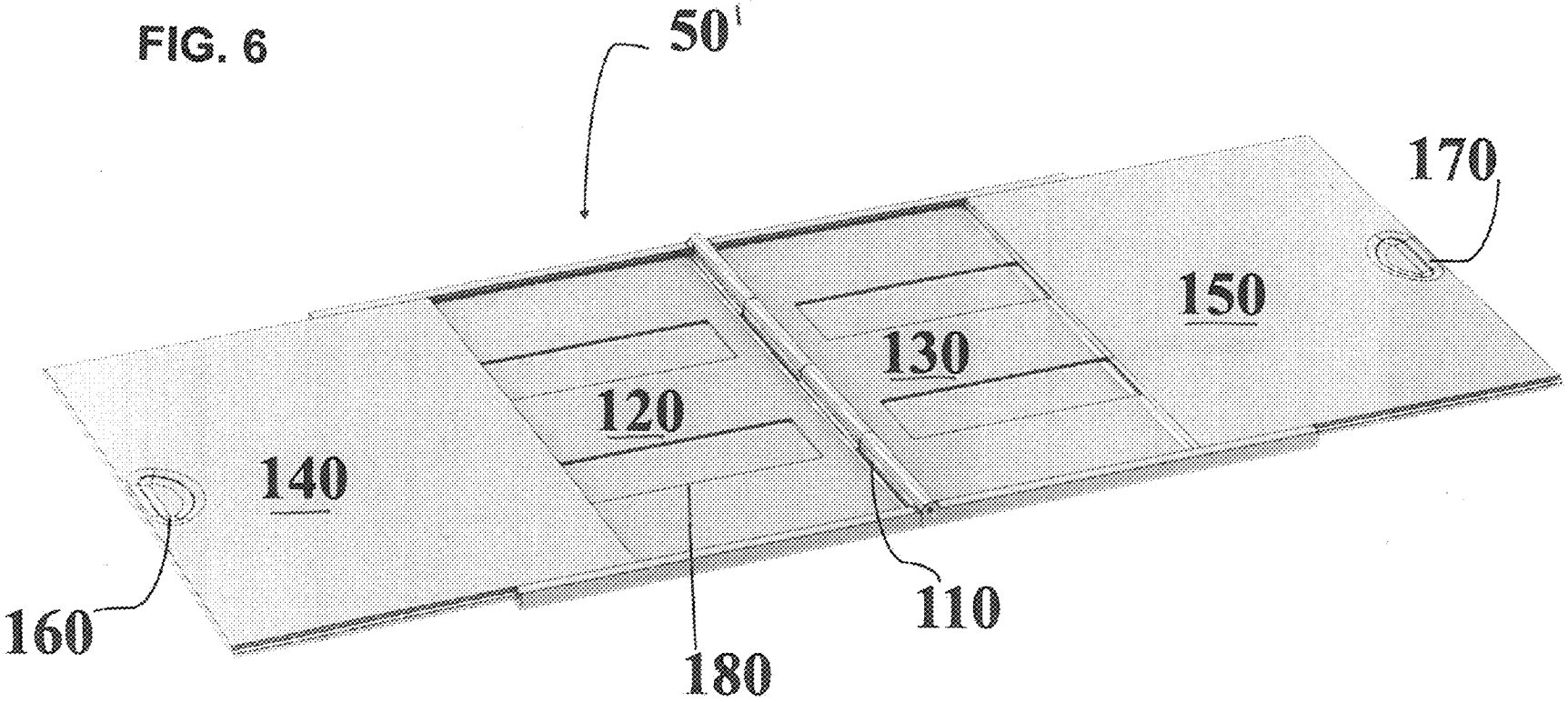
FIG. 6 is a bottom perspective view of the apparatus in an open configuration for use with a pedestal-type sink or other sink forming one aspect of this disclosure.
Figure 7:
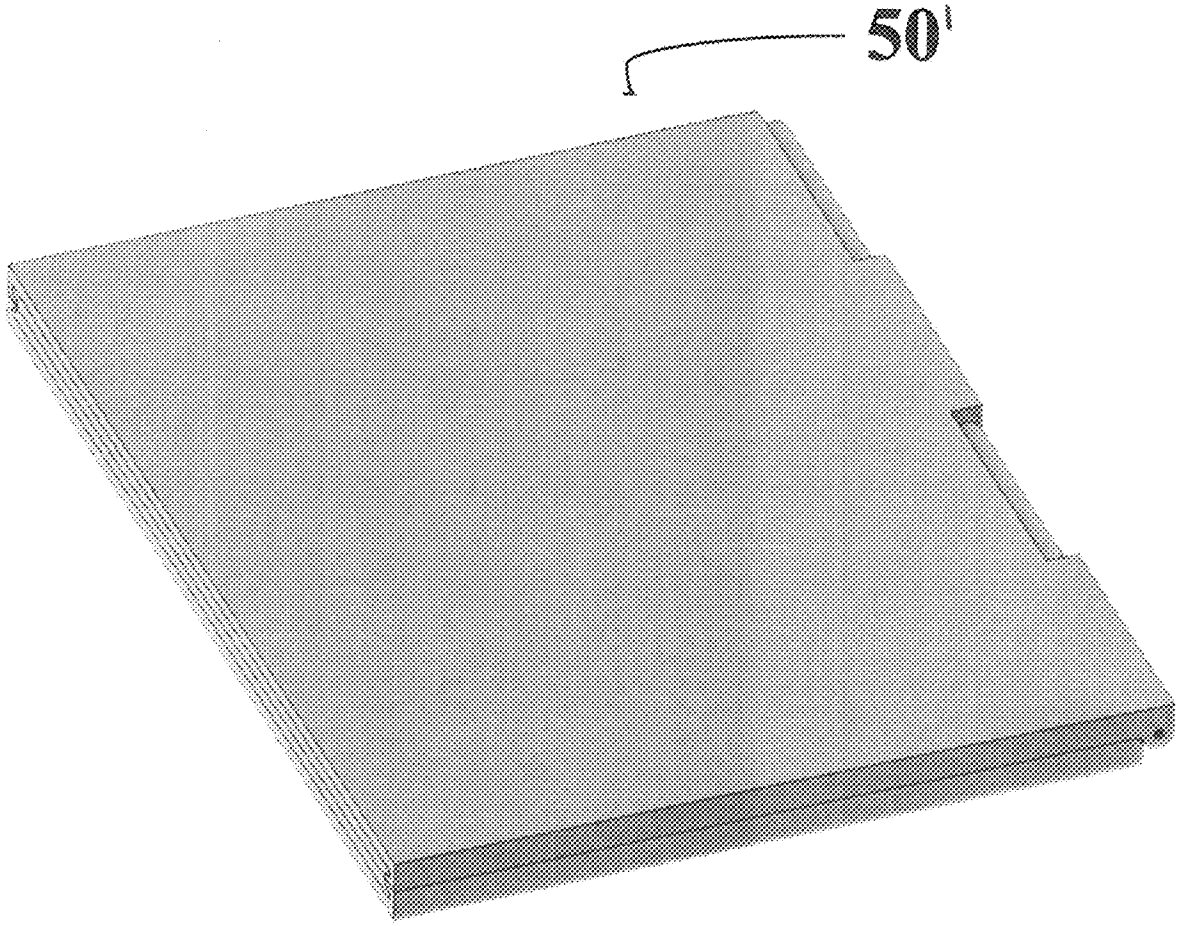
FIG. 7 is a perspective view of the apparatus in a closed configuration for use with a pedestal-type sink or other sink forming one aspect of this disclosure.
Figure 8:
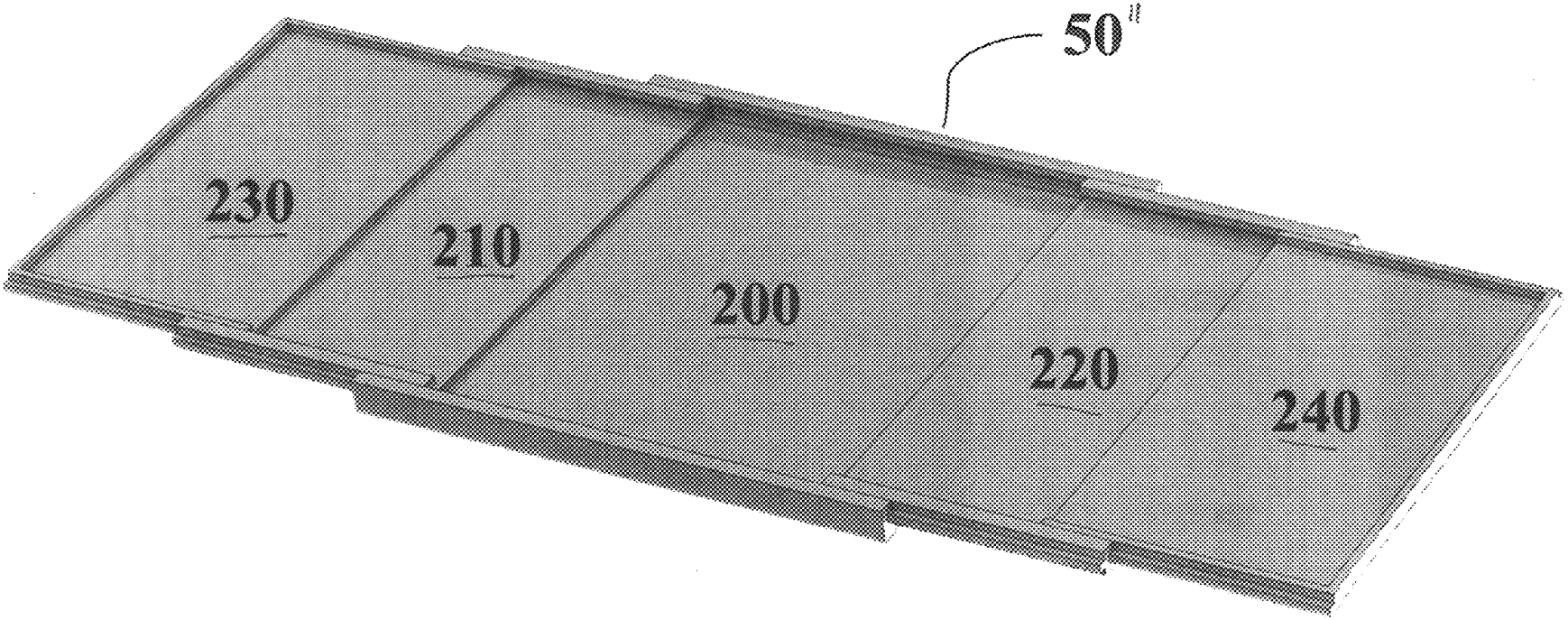
FIG. 8 is a top perspective view of an apparatus in an open configuration for use with a pedestal-type sink or other sink forming one aspect of this disclosure.
Figure 9:
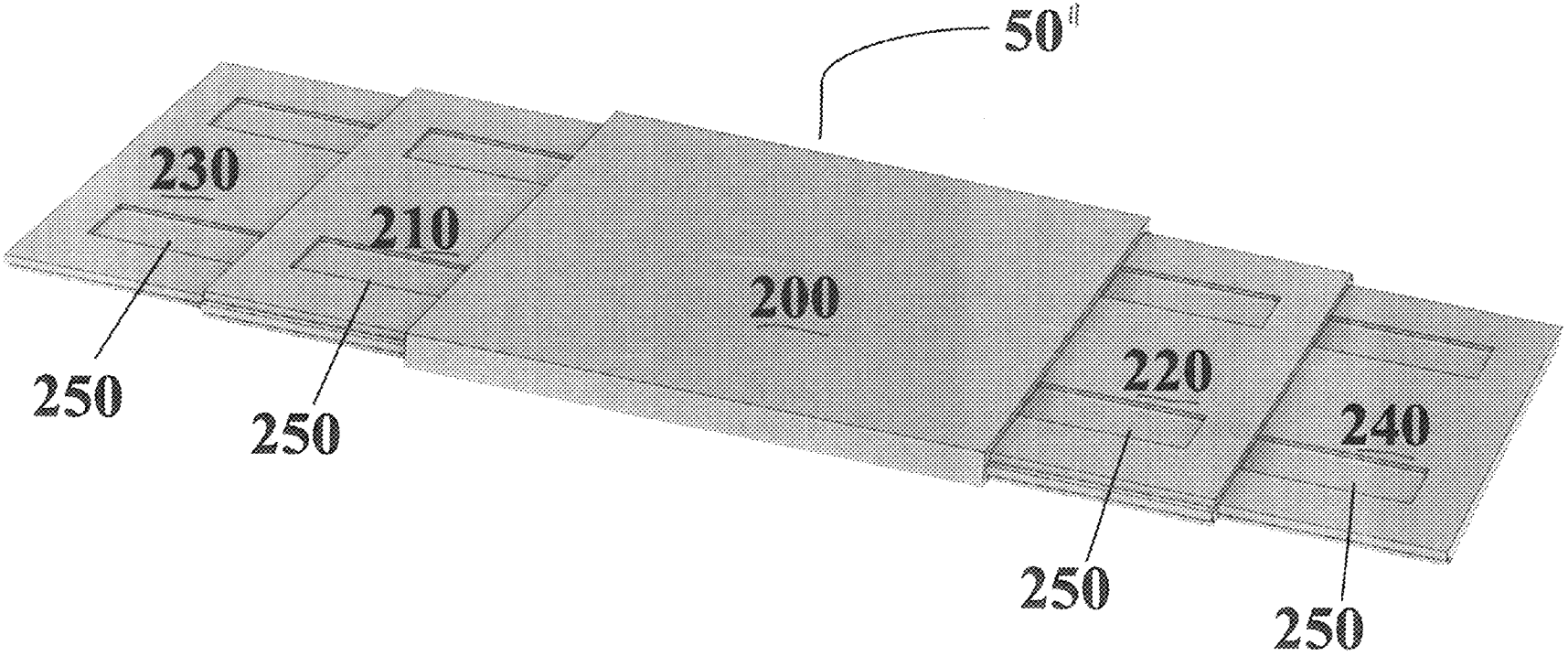
FIG. 9 is a bottom perspective view of the apparatus in an open configuration for use with a pedestal-type sink or other sink forming one aspect of this disclosure.
Figure 10:
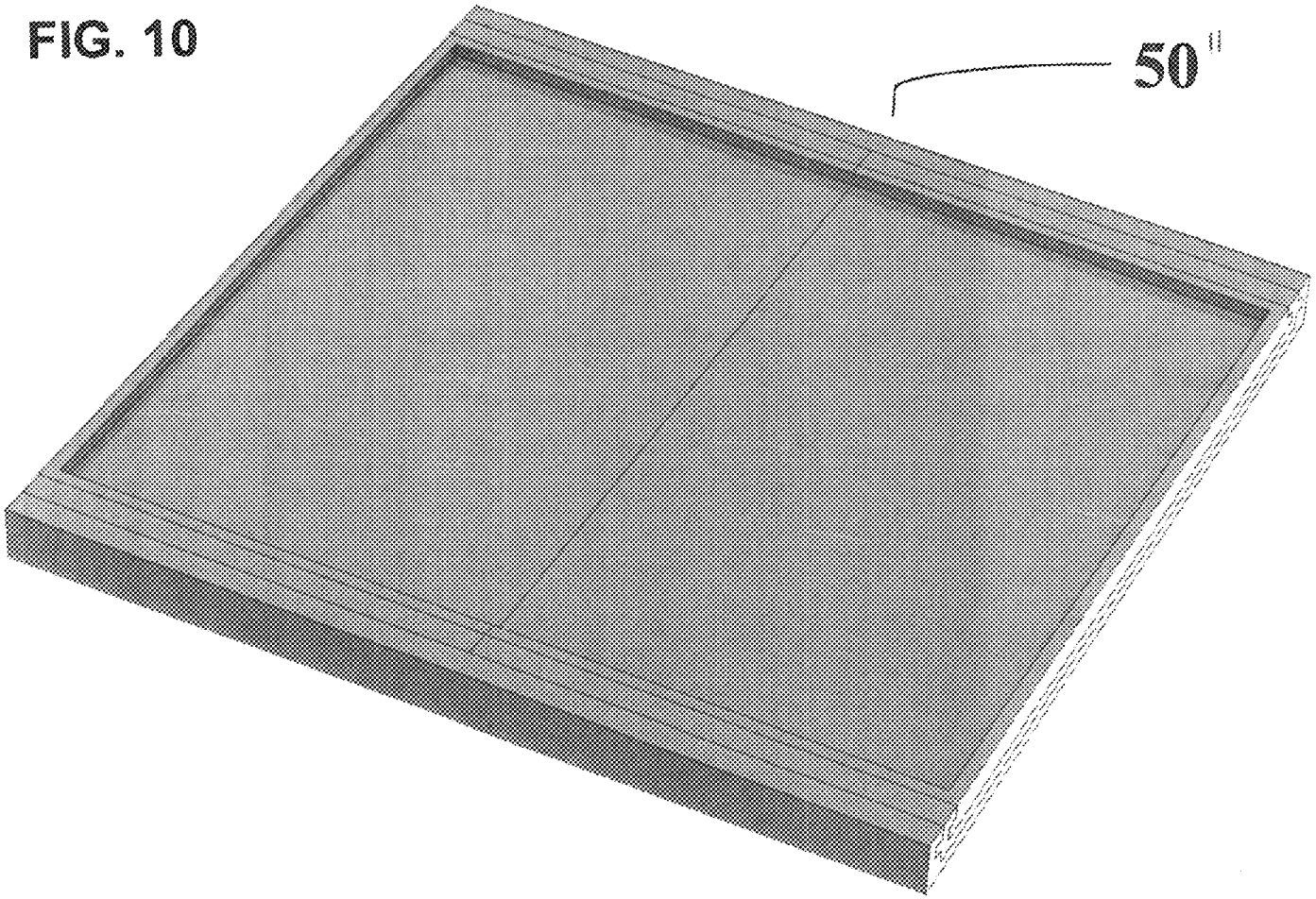
FIG. 10 is a perspective view of the apparatus in a closed configuration for use with a pedestal-type sink or other sink forming one aspect of this disclosure.

As shown in FIGS. 2-10, the apparatus 50 may be foldable or slidable into a substantially rectangular for covering the sink. In use, the apparatus 50 is initially in its closed position such that it a substantially rectangular or square shape as illustrated in FIGS. 4, 7 and 10. As a result, it may be easily stored in a suitcase or other travel bag for ease in transport. The weight and durability of the apparatus 50 is designed to keep it shut and held in place over the sink. In the embodiment shown in FIGS. 2-4, the apparatus 50 includes four interconnected rectangular panels 60, 70, 80 and 90. Of course, it should be appreciated that the number and shape of the panels may be varied in other embodiments.

The panels are hingedly connected to one another such that the apparatus 50 is a single unit construction. The hinges 110 are substantially the same size extending from a top edge of the panel to the bottom edge of the panel. The hinges 110 are positioned on the bottom side of the panels (the side touching the sink basin) such that the top side of the interconnected panels is substantially flat from one end to the opposite end. The panels will unfold and/or slide such that they will cover the sink. The weight of the apparatus allows it to maintain its position on the countertop of the sink without the need for any additional fastening means.

The two inner panels 60, 70 may be unfolded along a pinned edge extending along an inner edge of each of the first and second inner panels such that two panels are exposed. Subsequently, the two outer panels 80, 90 may be unfolded from the respective inner panels to expose all four of the panels in a first, open or operating position. In more detail, the first outer panel 80 is foldably connected to the first inner panel 60 via a pinned hinge extending along an outer edge of the first inner section. Similarly, the second outer panel 90 is foldably connected to the second inner panel 70 via a pinned hinge extending along an outer edge of the second inner section. As shown in FIG. 2, the two inner panels may be slightly taller than the two outer panels.

Turning to FIGS. 3 and 4, the two outer panels 80, 90 fit into a recessed, bottom portion of the inner panels 60, 70. When the outer panels are unfolded from the inner panels, the recessed portion of the inner panels is exposed. This is the bottom side of the apparatus, which is placed on the countertop. The raised hinges 110 may fit within the basin of the sink to provide additional securing means. Turning back to FIG. 2, in the open position, the panels of the apparatus lay flat in a generally planar configuration. One or more of the panels is surrounded on the outer edge by a smooth raised edge or lip 100. In one particular embodiment, the raised edge or lip 100 may extend around the entirety of the panels. As a result, personal and cosmetic products that are positioned within the recessed portion will not simply slide off the apparatus as the edges prevent them from falling onto the floor. Although the inner panels are recessed on the bottom portion, this is solely for ease of storage and to reduce the weight of the apparatus. Advantageously, there are not any individual recessed portions, trays or cut-outs in the top portion of the body of the panels because cosmetic and beauty items, such as eyeliner, lipstick and the like are not universally sized. Accordingly, the apparatus 50 is configured for use with any type of cosmetic and beauty products.

The apparatus 50 may simply be positioned on the top of the sink, such that the basin is substantially covered. The bottom surface of the apparatus 50 is substantially flush on top of the sink (when the hinges are positioned within the basin of the sink) such that it is flat and products may be placed on the extended counter space without moving. Once the individual is finished using the apparatus 50, the outer panels 80, 90 may be folded along the hinged portions 110 into the inner panels 60, 70 and then the inner panels 60, 70 may be folded on top of one another forming a square or rectangular shape. In this second or closed/storage position, the apparatus 50 may be easily transported and/or stored.

In another embodiment illustrated in FIGS. 5-7, the apparatus 50' includes a plurality of interconnected panels 120, 130, 140 and 150. The inner panels 120, 130 are hingedly connected to one another via a pinned hinge located between the two panels. Once the inner panels are unfolded, the outer panels 140, 150 may slide out from the inner panels to extend to a particular size to cover the sink and extend the available countertop space. The outer panels 140, 150 may each have a handle or grip 160, 170 on the bottom side, such as a small depression to allow an operator to grab the panels to aid in sliding the outer panels from the inner panels. The inner panels 120, 130 may have recessed portions 180 on the bottom portion to reduce weight of the apparatus.

Turning to FIGS. 8-10, another embodiment of the apparatus 50" is illustrated. In this embodiment, the apparatus has interconnected panels that are stored within a base panel 200. A plurality of panels 210, 220, 230 and 240 may slide and extend out from a base panel 200 (two panels on each side of the base panel are shown in FIGS. 8-10 although the number of panels may be varied). In use, the base panel 200 may be placed over the sink and then two intermediate panels 210, 220 may be extended from each side of the base panel. Furthermore, two outer panels 230, 240 may be extended from each of the respective intermediate panels. As shown in FIG. 9, each of the intermediate and outer panels have recesses 250 on a bottom side. After the apparatus is used, the panels may be slid into the base panel such that the apparatus forms a square or rectangular for easy transport and storage of the apparatus.

Since the apparatus 50 is often used with cosmetic products as well as hair and skin care products, these products are often spilled on the actual surface. Thus, the apparatus 50 should be easy to clean and heat resistant to the hair and styling tools, such as curling irons. The apparatus 50 may be made in various colors and designs in order to match the particular sink countertop it is being used. Furthermore, the apparatus 50 may be imprinted with certain logos, patterns, prints or designs, such as college insignias, professional sports team logos, fraternity or sorority letters, inspirational quotes, personalized photos or monograms.

The foregoing descriptions of various embodiments have been presented for purposes of illustration and description. These descriptions are not intended to be exhaustive or to limit the invention to the precise forms disclosed. The embodiments described provide the best illustration of the inventive principles and their practical applications to thereby enable one of ordinary skill in the art to utilize the disclosure in various embodiments and with various modifications as are suited to the particular use contemplated.

The invention claimed is:

1. A portable apparatus adapted for use with a sink having a basin; comprising:

at least four planar interconnected panels for positioning on a top surface of the sink, wherein each of the plurality of interconnected panels is made of a heat-resistant material; and a plurality of pinned hinges hingedly connecting adjacent ends of the interconnected panels, wherein the ends of the outer panels being free of the hinges whereby the plurality of interconnected panels are configured to be positionable in a first position to cover the sink basin and a second position for storage, wherein the inner panels include a raised lip into which the outer panels extend between in the second position.

2. The apparatus according to claim 1, wherein each of the at least four planar interconnected panels is made of an anti-microbial plastic.

3. The apparatus according to claim 1, wherein each of the at least four planar interconnected panels is made of a non-pliable plastic.

4. The apparatus according to claim 1, wherein each of the at least four planar interconnected panels is substantially rectangular shaped.

5. The apparatus according to claim 1, wherein each of the at least four planar interconnected panels is substantially square shaped.

6. A portable apparatus adapted for removably covering a top surface of a sink, comprising:

a plastic, non-pliable body, said body formed of at least four planar, rigid panels, wherein the plastic non-pliable body is heat-resistant and coated with an anti-microbial agent; and a plurality of pinned hinges connecting adjacent ends of the at least four panels, wherein the ends of the outer panels being free of the pinned hinges, whereby the at least four panels are configurable to expand into an open position for covering the sink and configurable to fold into a closed position for storage, wherein the inner panels comprise a raised lip into which the outer panels extend between in the closed position.

7. The apparatus according to claim 6, wherein each of the plurality of pinned hinges are substantially the same size.

8. The apparatus according to claim 6, wherein the at least four rigid panels form a generally planar upper surface in the open position.

9. The apparatus according to claim 8, wherein a bottom portion of the at least four rigid panels are substantially flush with the top surface of the sink in the open position.

10. The apparatus according to claim 6, wherein the at least four rigid panels are substantially parallel in a stackable configuration to one another in the closed position.

11. A foldable bathroom sink cover adapted for use with a sink, comprising:

a first inner section and a second inner section, wherein the first and second inner sections are foldably connected to each other via a pinned hinge extending along an inner edge of each of the first and second inner sections; and a first outer section and a second outer section, wherein the first outer section is foldably connected to the first inner section via a second pinned hinge extending along an outer edge of the first inner section and wherein the second outer section is foldably connected to the second inner section via a third pinned hinge extending along an outer edge of the second inner section, whereby the outer ends of the first and second outer sections being free of the pinned hinges, whereby the first inner section, the second inner section, the first outer section and the second outer section are removably positionable in a first planar position to cover the bathroom sink for supporting cosmetics, vanity and other personal products and a second position remote from the sink wherein the first and second inner sections comprise a raised lip into which the first and second outer sections extend between in the second position.

12. The foldable bathroom sink cover according to claim 11, wherein the first, second and third pinned hinges are substantially the same size.

* * * * *